US008575829B2

(12) United States Patent
Ma et al.

(10) Patent No.: US 8,575,829 B2
(45) Date of Patent: Nov. 5, 2013

(54) SPARK PLUG INCLUDING HIGH TEMPERATURE PERFORMANCE ELECTRODE

(75) Inventors: Shuwei Ma, Ann Arbor, MI (US); James D. Lykowski, Temperance, MI (US)

(73) Assignee: Federal-Mogul Ignition Company, Southfield, MI (US)

( * ) Notice: Subject to any disclaimer, the term of this patent is extended or adjusted under 35 U.S.C. 154(b) by 181 days.

(21) Appl. No.: 12/837,026

(22) Filed: Jul. 15, 2010

(65) Prior Publication Data

US 2011/0012498 A1 Jan. 20, 2011

Related U.S. Application Data

(60) Provisional application No. 61/225,615, filed on Jul. 15, 2009.

(51) Int. Cl.
*H01T 13/20* (2006.01)

(52) U.S. Cl.
USPC ..... 313/141; 313/118; 445/7

(58) Field of Classification Search
USPC ..... 313/141, 118; 445/7
See application file for complete search history.

(56) References Cited

U.S. PATENT DOCUMENTS

| | | | | |
|---|---|---|---|---|
| 3,958,144 | A * | 5/1976 | Franks | 313/138 |
| 4,881,913 | A * | 11/1989 | Mann | 445/7 |
| 6,885,135 | B2 * | 4/2005 | Kanao et al. | 313/141 |
| 7,521,850 | B2 * | 4/2009 | Lykowski | 313/144 |
| 7,569,979 | B2 | 8/2009 | Lykowski et al. | |
| 2002/0130602 | A1 * | 9/2002 | Kanao et al. | 313/141 |
| 2004/0100178 | A1 | 5/2004 | Kanao et al. | |
| 2005/0194877 | A1 | 9/2005 | Horn et al. | |
| 2007/0057613 | A1 * | 3/2007 | Brady et al. | 313/141 |
| 2007/0114899 | A1 * | 5/2007 | Lykowski | 313/141 |
| 2007/0114900 | A1 * | 5/2007 | Lykowski | 313/141 |
| 2007/0222350 | A1 | 9/2007 | Lykowski et al. | |

(Continued)

FOREIGN PATENT DOCUMENTS

| | | |
|---|---|---|
| CN | 101361241 | 2/2009 |
| CN | 101454955 | 6/2009 |

(Continued)

OTHER PUBLICATIONS

International Search Report for PCT/US2010/041890 dated Jan. 24, 2011, 2 pages.

(Continued)

*Primary Examiner* — Nimeshkumar Patel
*Assistant Examiner* — Thomas A Hollweg
(74) *Attorney, Agent, or Firm* — Reising Ethington P.C.

(57) ABSTRACT

A spark plug includes at least one electrode having a sparking end. The sparking end is formed of a high temperature performance alloy including chromium in an amount of 10.0 weight percent to 60.0 weight percent, palladium in an amount of 0.5 weight percent to 10.0 weight percent, and a balance substantially of at least one of molybdenum and tungsten. The sparking end presents a spark contact surface, and at a temperature of at least 500° C., such as during use of the spark plug in an internal combustion engine, a layer of chromium oxide ($Cr_2O_3$) forms at said spark contact surface. The layer of $Cr_2O_3$ protects the bulk of the sparking end from the extreme conditions of the combustion chamber and prevents erosion, corrosion, and balling.

21 Claims, 4 Drawing Sheets

(56) References Cited

U.S. PATENT DOCUMENTS

| | | | | |
|---|---|---|---|---|
| 2007/0236123 | A1* | 10/2007 | Lykowski et al. | 313/141 |
| 2007/0236125 | A1* | 10/2007 | Lykowski et al. | 313/141 |
| 2007/0290593 | A1 | 12/2007 | Kowalski | |

FOREIGN PATENT DOCUMENTS

| | | | | |
|---|---|---|---|---|
| CN | 101461106 | | 6/2009 | |
| CN | 101467316 | | 6/2009 | |
| JP | 03-225785 | | 10/1991 | |
| JP | 05-198349 | | 8/1993 | |
| JP | 2004235040 | | 8/2004 | |
| JP | 2004235040 | A * | 8/2004 | H01T 13/39 |
| KR | 10-2008-0071460 | | 8/2008 | |

OTHER PUBLICATIONS

Office Action for Chinese Patent Application No. 201080041079.2, Dec. 13, 2012, 18 pages, English translation of Office Action included after the Chinese Office Action.

EP Extended Search Report for European Patent Application No. 10800443.3 from PCT/US2010041890, Apr. 19, 2013, 6 pages.

NN; Refractory Metals; Wikipedia, Internet site: URL:http://web.archive.org/web/20090225154132/http://en.wikipedia. org/wiki/Refractory metals [retrieved Apr. 11, 2013]; 3 pages; Feb. 25, 2009.

* cited by examiner

SPARK PLUG INCLUDING HIGH TEMPERATURE PERFORMANCE ELECTRODE

CROSS REFERENCE TO RELATED APPLICATION

This application claims priority to U.S. Provisional Application Ser. No. 61/225,615, filed Jul. 15, 2009, which is incorporated herein by reference.

BACKGROUND OF THE INVENTION

1. Field of the Invention

The present invention is directed to spark plugs of internal combustion engines, and more particularly, to spark plugs including high temperature performance electrodes.

2. Description of the Prior Art

Spark plugs are widely used to initiate combustion in an internal combustion engine. Spark plugs typically include a ceramic insulator, a conductive shell surrounding the ceramic insulator, a central electrode disposed in the ceramic insulator, and a ground electrode operatively attached to the conductive shell. The electrodes each have a sparking end, such as a tip, disk, rivet, or other shaped portion. Each sparking end presents an outer surface, including a spark contact surface. The spark contact surfaces of the sparking ends are typically exposed planar surfaces located proximate one another and defining a spark gap therebetween. Such spark plugs ignite gases in an engine cylinder by emitting an electrical spark jumping the spark gap between the central electrode and ground electrode, the ignition of which creates a power stroke in the engine.

Due to the nature of internal combustion engines, spark plugs operate in an extreme environment of high temperatures of at least 500° C. and various corrosive combustion gases which has traditionally reduced the longevity of the spark plug. The sparking ends or material adjacent the sparking ends of the electrodes also experience electrical erosion due to localized vaporization resulting from high arc temperatures of the electrical arc during operation of the spark plug. The electrodes may also experience growth of various particulates and oxidation, particularly at the sparking ends. Over time, the electrical spark erosion, particulates, and oxidation reduces the quality of the spark between the center electrode and ground electrode, which in turn affects the performance of the spark plug, and the resulting ignition and combustion.

Existing spark plug electrodes are often formed of a nickel (Ni) material, such as pure Ni or Ni alloys having high resistance to corrosion and oxidation. However, such Ni electrodes experience a significant amount of electrical spark erosion which limits their use in spark plugs.

In attempt to reduce the amount of electrical spark erosion and improve the performance of Ni electrodes, sparking ends formed of precious metal materials have been attached to a base formed of Ni material. The precious metal material is typically a platinum (Pt) material, such as pure Pt or alloys thereof. The sparking ends formed of the Pt material have a low electrical spark erosion rate and thus improve the performance of the electrode. However, the high cost of such precious metals limits their use throughout the entire electrode.

Further, the use of a Pt material in the sparking ends is limited because Pt materials experience balling or bridging due to excessive oxidation upon exposure to sparks and the extreme conditions of a combustion chamber. FIGS. 7 shows prior art sparking ends formed of a Pt alloy and including metal balls formed at the sparking ends. The metal balls typically grow over time and may bridge the spark gap between the central electrode and ground electrode. The bridging typically hinders the performance of the electrodes, which in turn affects the resulting ignition and combustion, including the power output, fuel efficiency, performance of the engine, and emissions.

Sparking ends have also been formed of Iridium (Ir) material, such as pure Ir or alloys thereof. The Ir materials do not experience the balling or spark erosion experienced by the Ni materials and Pt materials. However, the use of Ir materials is limited because such materials experience corrosion in the presence of calcium (Ca) and phosphorus (P). Ca and P are often present in engine oils and oil additives, which the sparking ends are exposed to during operation of the spark plug in an internal combustion engine. Recently, increasing amounts of Ca and P are found in combustion materials as engine manufacturers attempt to reduce friction to increase fuel economy by alloying more engine oil to seep into the combustion chamber.

SUMMARY OF THE INVENTION AND ADVANTAGES

One aspect of the invention provides a spark plug comprising at least one electrode having a sparking end formed of a high temperature performance alloy. The high temperature performance alloy includes, in weight percent of the high temperature performance alloy, chromium in an amount of 10.0 weight percent to 60.0 weight percent, palladium in an amount of 0.5 weight percent to 10.0 weight percent, and a balance substantially of at least one of molybdenum and tungsten.

Another aspect of the invention provides an electrode for use in a spark plug of an internal combustion engine having a sparking end formed of a high temperature performance alloy. The high temperature performance alloy includes, in weight percent of the high temperature performance alloy, chromium in an amount of 10.0 weight percent to 60.0 weight percent, palladium in an amount of 0.5 weight percent to 10.0 weight percent, and a balance substantially of at least one of molybdenum and tungsten.

Another aspect of the invention provides a method of fabricating a spark plug including an electrode having a sparking end, comprising the steps of, providing a power metal material including chromium, palladium, and at least one of molybdenum and tungsten, forming the powder metal material into a sparking end of an electrode, and heating said powder metal material to provide a high temperature performance alloy, comprising, in weight percent of the high temperature performance alloy, chromium in an amount of 10.0 weight percent to 60.0 weight percent, palladium in an amount of 0.5 weight percent to 10.0 weight percent, and a balance substantially of at least one of molybdenum and tungsten.

The sparking end formed of the high temperature performance alloy provides a high resistance to corrosion and oxidation, similar to the corrosion and oxidation resistance provided a sparking end formed of Ni material. However, the high temperature performance alloy is better suited for the sparking end of the electrode because, unlike the Ni materials, the high temperature performance alloy is also resistant to electrical spark erosion.

The electrical spark erosion rate of the high temperature performance alloy is about equal to the electrical spark erosion rates of Pt and Pt—Ni materials. However, the high temperature performance alloy is better suited for the sparking ends of the electrode because the high temperature performance alloy does not experience balling at temperatures greater than 500° C. Thus, the sparking end formed of the high temperature performance alloy provides improved performance of the spark plug 20.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 1A:
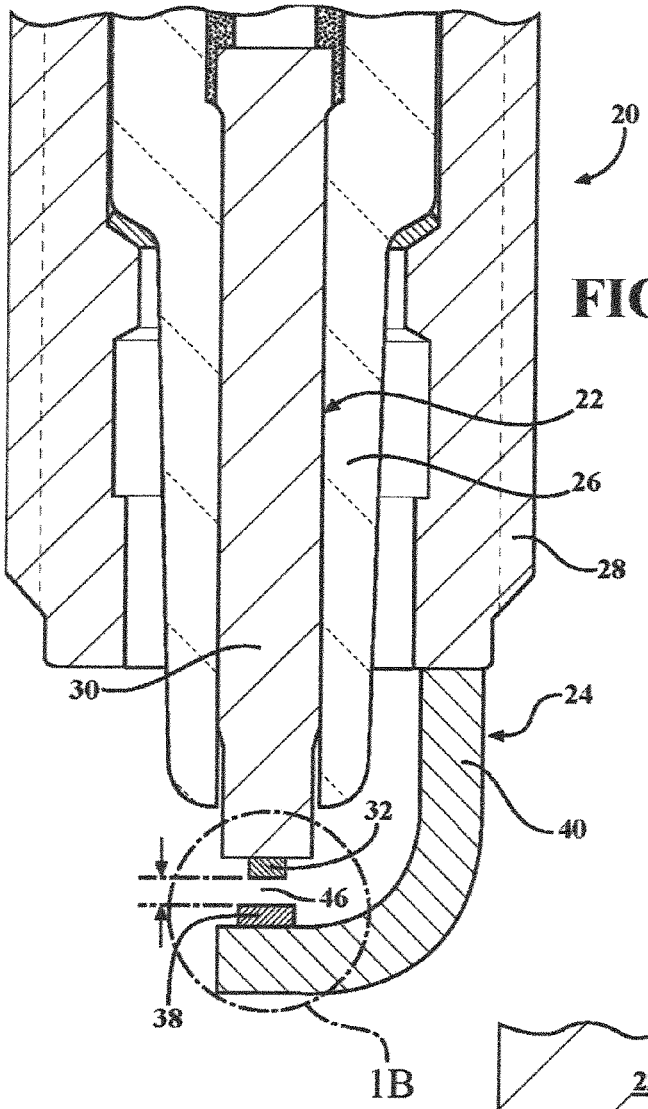
FIG. 1*a* is a longitudinal cross sectional view of a spark plug according to one embodiment of the subject invention before exposure to a temperature of at least 500° C.
Figure 1B:
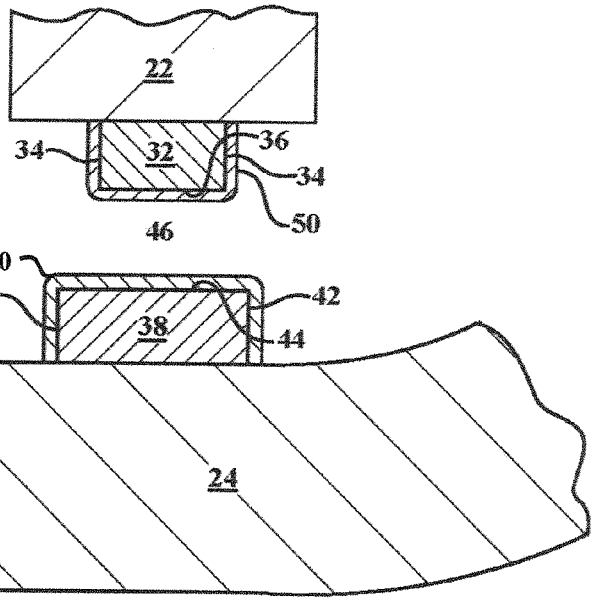
FIG. 1*b* is an enlarged cross sectional view of a sparking end of the spark plug of FIG. 1 a after exposure to a temperature of at least 500° C.

Referring to FIG. 1*a*, a representative spark plug 20 for igniting a mixture of fuel and air in an internal combustion engine is shown. One aspect of the invention provides an electrode 22, 24 having a sparking end 32, 38 formed of a high temperature performance alloy. The sparking end 32, 38 presents an outer surface 34, 42, including a spark contact surface 36, 44, as shown in FIG. 1*b*. The high temperature performance alloy includes, in weight percent of the high temperature performance alloy, chromium (Cr) in an amount of 10.0 weight percent to 60.0 weight percent, palladium (Pd) in an amount of 0.5 weight percent to 10.0 weight percent, and a balance substantially of at least one of molybdenum (Mo) and tungsten (W). In one embodiment, the sparking end 32, 38 includes a layer 50 of chromium oxide ($Cr_2O_3$) at the spark contact surface 36, 44 at a temperature of at least 500° C., such as during use of the spark plug 20 in an internal combustion engine, as shown in FIG. 1*b*. The high temperature performance alloy provides a sufficient performance at temperatures greater than 500° C. without significant electrical spark erosion, corrosion, balling, or oxidation. Thus, the high temperature performance alloy provides improved performance of the spark plug 20.

The presence and amount of each element of the high temperature performance alloy is determined after sintering the high temperature performance alloy. The weight percent of each element is based on the total weight of the high temperature performance alloy. The weight percent of each individual element is determined by first determining the mass of the individual element in the high temperature performance alloy and dividing the mass of the individual element by the total mass of the high temperature performance alloy. The presence and amount of each element in the high temperature performance alloy may be detected by a chemical analysis or by viewing an Energy Dispersive Spectra (E.D.S.) of the sparking end 32, 38. The E.D.S. may be generated by a Scanning Electron Microscope (S.E.M.) instrument.

The high temperature performance alloy includes Cr in an amount sufficient to substantially affect the oxidation performance of the high temperature performance alloy. The amount of Cr directly impacts the presence, amount, and thickness of the $Cr_2O_3$ layer 50. In one embodiment, the high temperature performance alloy includes Cr in an amount of 10.0 weight percent to 60.0 weight percent. In another embodiment, the high temperature performance alloy includes Cr in an amount of 15.0 weight percent to 58.0 weight percent. In yet another embodiment, the high temperature performance alloy includes Cr in an amount of 23.0 weight percent to 47.0 weight percent.

In one embodiment, the high temperature performance alloy includes Cr in an amount of at least 10.0 weight percent. In another embodiment, the high temperature performance alloy includes Cr in an amount of at least 24.0 weight percent. In yet another embodiment, the high temperature performance alloy includes Cr in an amount of at least 43.0 weight percent.

In one embodiment, the high temperature performance alloy includes Cr in an amount less than 59.0 weight percent. In another embodiment, the high temperature performance alloy includes Cr in an amount less than 55.0 weight percent. In yet another embodiment, the high temperature performance alloy includes Cr in an amount less than 30.0 weight percent.

The high temperature performance alloys includes Pd in an amount sufficient to substantially affect the oxidation performance of the high temperature performance alloy. In one embodiment, the high temperature performance alloy includes Pd in an amount of 0.5 weight percent to 10.0 weight percent. In another embodiment, the high temperature performance alloy includes Pd in an amount of 0.9 weight percent to 7.6 weight percent. In yet another embodiment, the high temperature performance alloy includes Pd in an amount of 3.6 weight percent to 5.0 weight percent.

In one embodiment, the high temperature performance alloy includes Pd in an amount of at least 0.5 weight percent. In another embodiment, the high temperature performance alloy includes Pd in an amount of at least 1.6 weight percent. In yet another embodiment, the high temperature performance alloy includes Pd in an amount of at least 6.3 weight percent.

In one embodiment, the high temperature performance alloy includes Pd in an amount less than 10.0 weight percent. In another embodiment, the high temperature performance alloy includes Pd in an amount less than 8.4 weight percent. In yet another embodiment, the high temperature performance alloy includes Pd in an amount less than 3.0 weight percent.

The high temperature performance alloy includes at least one of Mo and W in an amount sufficient to substantially affect the spark erosion rate of the high temperature performance alloy. In one embodiment, the high temperature performance alloy includes a balance of at least one of Mo and W.

The weight percent of the at least one of Mo and W is equal to the sum of the weight percent of the Mo in the high temperature performance alloy and the weight percent of the W in the high temperature performance alloy. The weight percent of the Mo and W is determined by first determining the mass of the Mo in the high temperature performance alloy and determining mass of the W in the high temperature performance alloy, obtaining the sum of the mass of the Mo and the mass of the W, and then dividing the sum by the total mass of the high temperature performance alloy.

In one embodiment, the high temperature performance alloy includes at least one of Mo and W in an amount of 10.5 weight percent to 90.0 weight percent. In other words, the balance of the high temperature performance alloy includes at least one of Mo and W in an amount of 10.5 weight percent to 90.0 weight percent. In another embodiment, the high temperature performance alloy includes at least one of Mo and W in an amount of 24.8 weight percent to 85.2 weight percent. In yet another embodiment, the high temperature performance alloy includes at least one of Mo and W in an amount of 30.5 weight percent to 71.4 weight percent.

In one embodiment, the high temperature performance alloy includes at least one of Mo and W in an amount of at least 10.5 weight percent. In another embodiment, the high temperature performance alloy at least one of Mo and W in an amount of at least 30.4 weight percent. In yet another embodiment, the high temperature performance alloy includes at least one of Mo and Win an amount of at least 41.9 weight percent.

In one embodiment, the high temperature performance alloy includes at least one of Mo and W in an amount less than 90.5 weight percent. In another embodiment, the high temperature performance alloy includes at least one of Mo and W in an amount less than 84.5 weight percent. In yet another embodiment, the high temperature performance alloy includes at least one of Mo and W in an amount less than 60.3 weight percent.

In one embodiment, the high temperature performance alloy includes Mo in an amount of 10.5 weight percent to 90.0 weight percent. In another embodiment, the high temperature performance alloy includes Mo in an amount of 25.7 weight percent to 79.2 weight percent. In yet another embodiment, the high temperature performance alloy includes Mo in an amount of 32.4 weight percent to 66.4 weight percent.

In one embodiment, the high temperature performance alloy includes W in an amount of 10.5 weight percent to 90.0 weight percent. In another embodiment, the high temperature performance alloy includes W in an amount of 22.3 weight percent to 77.1 weight percent. In yet another embodiment, the high temperature performance alloy includes W in an amount of 31.1 weight percent to 50.9 weight percent.

In one embodiment, the high temperature performance alloy includes Mo in an amount of 1.0 weight percent to 89.0 weight percent and W in an amount of 1.0 weight percent to 89.0 weight percent. In another embodiment, the high temperature performance alloy includes Mo in an amount of 1.0 weight percent to 30.0 weight percent and W in an amount of 35.0 weight percent to 60.0 weight percent. In yet another embodiment, the high temperature performance alloy includes Mo in an amount of 23.0 weight percent to 29.7 weight percent and W in an amount of 4.2 weight percent to 21.9 weight percent.

Figure 3A:
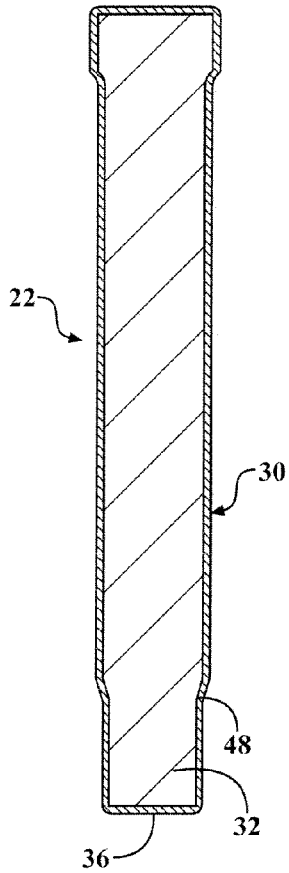
FIG. 3*a* is a cross sectional view of a center electrode of a third embodiment including a coating of Pd before exposure to a temperature of at least 500° C.
Figure 3B:
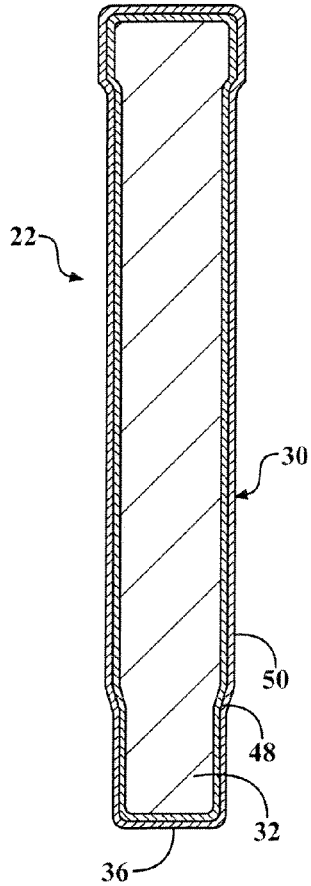
FIG. 3*b* is a cross sectional view of the center electrode of FIG. 3*a* after exposure to a temperature of at least 500° C.
Figure 5A:
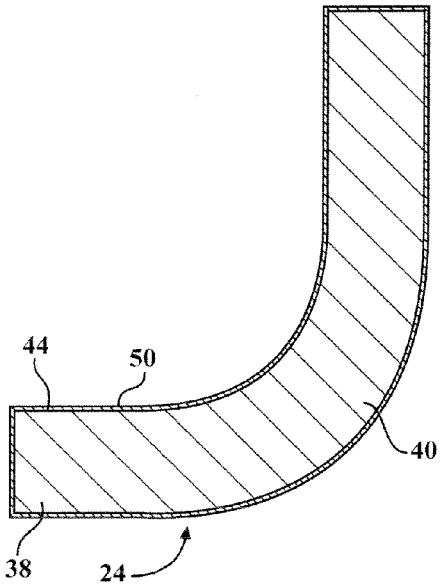
FIG. 5*a* is a longitudinal cross sectional view of a ground electrode of a fifth embodiment before exposure to a temperature of at least 500° C.
Figure 5B:
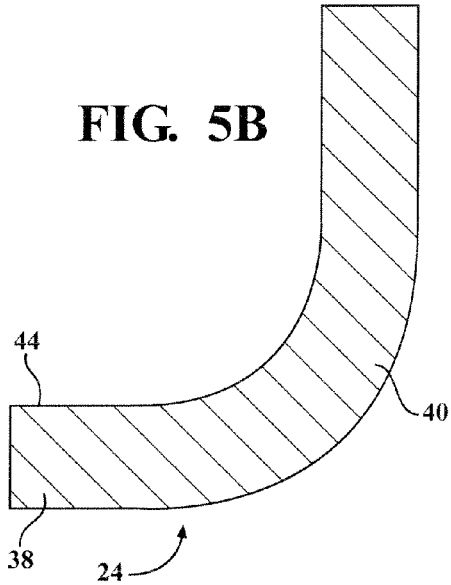
FIG. 5*b* is a longitudinal cross sectional view of the ground electrode of FIG. 5*a* after exposure to a temperature of at least 500° C.
Figure 7:
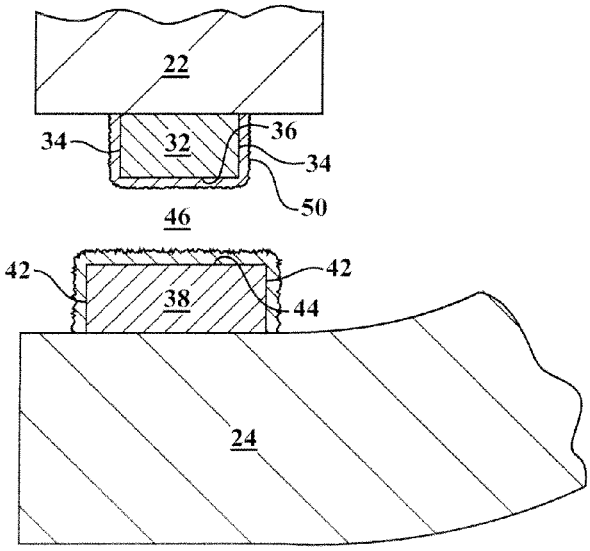
FIG. 7 Prior Art
FIG. 7 is a cross sectional view of sparking contact surfaces formed of a prior art Pt alloy showing balling.

In one embodiment, the sparking end 32, 38 includes the $Cr_2O_3$ layer 50 at the spark contact surface 36, 44 at a temperature of at least 500° C., such as during use of the spark plug 20 in an internal combustion engine, as shown in FIGS. 3*b* and 5*b*. When the high temperature performance alloy is heated to temperatures of at least 500° C., which is typically the operating temperature of an internal combustion engine, the $Cr_2O_3$ layer 50 forms along spark contact surface 36, 44, as shown in FIGS. 3*b* and 5*b*. The $Cr_2O_3$ layer 50 is dense, stable, and has low formation free energy. Thus, the $Cr_2O_3$ layer 50 protects the bulk of the sparking end 32, 38 from erosion, corrosion, and prevents balling at the sparking end 32, 38 due to sparks and the extreme conditions of the combustion chamber. Typically, $Cr_2O_3$ layer 50 forms along the entire outer surface 34, 42 of the sparking end 32, 38, including the spark contact surface 36, 44. However, the $Cr_2O_3$ layer 50 may be present only along the entire spark contact surface 36, 44, present only at portions of the spark contact surface 36, 44, present only at the entire spark contact surface 36, 44 and portions of the outer surface 34, 42, or present only at portions of the spark contact surface 36, 44 and portions of the outer surface 34, 42. Thus, at temperatures of at least 500° C., the sparking end 32, 38 comprises a gradient structure wherein the bulk of the sparking end 32, 38 includes Cr, Pd, and a balance substantially of at least one of Mo and W, and the outer surface 34, 42 includes the $Cr_2O_3$ layer 50. The $Cr_2O_3$ layer 50 is not present in the bulk of the sparking end 32, 38. Once the $Cr_2O_3$ layer 50 is formed at spark contact surface 36, 44, the $Cr_2O_3$ layer 50 will remain present at all temperatures.

The $Cr_2O_3$ layer 50 has a thickness substantially affecting the oxidation performance of the sparking end 32, 38. The thickness also provides sufficient discharge voltage and ablation volume per spark during operation of the spark plug 20 at temperatures of at least 500° C. The presence, amount, and thickness of the $Cr_2O_3$ layer 50 may be detected by heating the sparking end 32, 38 to a temperature of at least 500° C. and performing a chemical analysis on the sparking end 32, 38, or by generating and viewing an Energy Dispersive Spectra (E.D.S.) of the sparking end 32, 38 with an S.E.M. instrument.

In one embodiment, the $Cr_2O_3$ layer 50 has a thickness of 0.10 micrometer (μm) to 10.0 μm. In another embodiment, the $Cr_2O_3$ layer 50 has a thickness of 0.20 μm to 8.5 μm. In yet another embodiment, the $Cr_2O_3$ layer 50 has a thickness of 1.8 μm to 6.3 μm. In one embodiment, the thickness of the $Cr_2O_3$ layer 50 is consistent along the entire outer surface 34, 42 and spark contact surface 36, 44 of the sparking end 32, 38. In another embodiment, the thickness of the $Cr_2O_3$ layer 50 varies along the outer surface 34, 42 and spark contact surface 36, 44.

As alluded to above, the amount of Cr directly impacts the presence, amount, and thickness of the $Cr_2O_3$ layer 50. The high temperature performance alloy of the sparking end 32, 38 requires Cr in an amount of at least 10.0 weight percent in order for the $Cr_2O_3$ layer 50 to have a thickness substantially affecting the oxidation performance of the sparking end 32, 38. However, when the Cr is present in an amount greater than 60.0 weight percent, the $Cr_2O_3$ layer 50 has a thickness greater than 10.0 μm, which may lead to an increased and undesirable discharge voltage and ablation volume per spark during operation of the spark plug 20.

In one embodiment, the high temperature performance alloys includes yttrium (Y) in an amount sufficient to substantially affect the oxidation performance of the high temperature performance alloy. The Y increases the adhesion of the $Cr_2O_3$ layer 50 to the bulk of the sparking end 32, 38. In one embodiment, the high temperature performance alloy includes Y in an amount of 0.001 weight percent to 0.200 weight percent. In another embodiment, the high temperature performance alloy includes Y in an amount of 0.040 weight percent to 0.150 weight percent. In yet another embodiment, the high temperature performance alloy includes Y in an amount of 0.130 weight percent to 0.174 weight percent.

In one embodiment, the high temperature performance alloy includes Y in an amount of at least 0.001 weight percent. In another embodiment, the high temperature performance alloy includes Y in an amount of at least 0.036 weight percent. In yet another embodiment, the high temperature performance alloy includes Y in an amount of at least 0.090 weight percent.

In one embodiment, the high temperature performance alloy includes Y in an amount up to 0.200 weight percent. In another embodiment, the high temperature performance alloy includes Y in an amount up to 0.175 weight percent. In yet another embodiment, the high temperature performance alloy includes Y in an amount up to 0.110 weight percent.

In one embodiment, the high temperature performance alloy includes silicon (Si) in an amount sufficient to substantially affect the oxidation performance of the high temperature performance alloy. In one embodiment, the high temperature performance alloy includes Si in an amount of 0.001 weight percent to 0.500 weight percent. In another embodiment, the high temperature performance alloy includes Si in an amount of 0.009 weight percent to 0.441 weight percent. In yet another embodiment, the high temperature performance alloy includes Si in an amount of 0.010 weight percent to 0.391 weight percent.

In one embodiment, the high temperature performance alloy includes Si in an amount of at least 0.001 weight percent. In another embodiment, the high temperature performance alloy includes Si in an amount of at least 0.010 weight percent. In yet another embodiment, the high temperature performance alloy includes Si in an amount of at least 0.200 weight percent.

In one embodiment, the high temperature performance alloy includes Si in an amount up to 0.500 weight percent. In another embodiment, the high temperature performance alloy includes Si in an amount up to 0.450 weight percent. In yet another embodiment, the high temperature performance alloy includes Si in an amount up to 0.388 weight percent.

In one embodiment, the high temperature performance alloys includes at least one of Si and manganese (Mn) in an amount sufficient to substantially affect the oxidation performance of the high temperature performance alloy. The weight percent of the at least one of Si and Mn is equal to the sum of the weight percent of the Si in the high temperature performance alloy and the weight percent of the Mn in the high temperature performance alloy. As alluded to above, in one embodiment, the weight percent of the Si is limited to 0.500 weight percent of the high temperature performance alloy. The weight percent of the Si and Mn is determined by first determining the mass of the Si in the high temperature performance alloy and the mass of the Mn in the high temperature performance alloy, obtaining the sum of the mass of the Si and the mass of the Mn, and then dividing the sum by the total mass of the high temperature performance alloy.

In one embodiment, the high temperature performance alloy includes at least one of Si and Mn in an amount of 0.001 weight percent to 2.000 weight percent. In another embodiment, the high temperature performance alloy includes at least one of Si and Mn in an amount of 0.055 weight percent to 1.600 weight percent. In yet another embodiment, the high temperature performance alloy includes at least one of Si and Mn in an amount of 0.690 weight percent to 1.100 weight percent. As stated above, the weight percent of the Si is limited to 0.500 weight percent of the high temperature performance alloy.

In one embodiment, the high temperature performance alloy includes at least one of Si and Mn in an amount of at least 0.001 weight percent. In another embodiment, the high temperature performance alloy includes at least one of Si and Mn in an amount of at least 0.066 weight percent. In yet another embodiment, the high temperature performance alloy includes at least one of Si and Mn in an amount of at least 0.990 weight percent.

In one embodiment, the high temperature performance alloy includes at least one of Si and Mn in an amount up to 2.000 weight percent. In another embodiment, the high temperature performance alloy includes at least one of Si and Mn in an amount up to 1.700 weight percent. In yet another embodiment, the high temperature performance alloy includes at least one of Si and Mn in an amount up to 0.953 weight percent.

In one embodiment, the high temperature performance alloy includes Mn in an amount of 0.001 weight percent to 2.000 weight percent. In another embodiment, the high temperature performance alloy includes Mn in an amount of 0.077 weight percent to 1.922 weight percent. In yet another embodiment, the high temperature performance alloy includes Mn in an amount of 0.188 weight percent to 1.550 weight percent.

In one embodiment, the high temperature performance alloy includes Si in an amount of 0.001 weight percent to 1.900 weight percent and Mn in an amount of 0.001 weight percent to 1.900 weight percent. In another embodiment, the high temperature performance alloy includes Si in an amount of 0.001 weight percent to 0.500 weight percent and Mn in an amount of 0.5 weight percent to 1.950 weight percent. In yet another embodiment, the high temperature performance alloy includes Si in an amount of 0.540 weight percent to 1.800 weight percent and Mn in an amount of 0.001 weight percent to 0.780 weight percent.

In one embodiment, the sparking end 32, 38 formed of the high temperature performance alloy does not include any intentionally added Nickel (Ni) and is substantially free of any Ni. In one embodiment, the high temperature performance alloy includes Ni in an amount less than 5.0 weight percent. In another embodiment, the high temperature performance alloy includes Ni in an amount less than 2.7 weight percent. In yet another embodiment, the high temperature performance alloy includes Ni in an amount less than 0.2 weight percent.

In one embodiment, the sparking end 32, 38 includes a coating 48 of palladium (Pd) along the outer surface 34, 42, including the spark contact surface 36, 44, as shown in FIGS. 3*a* and 3*b*. As stated above, the bulk of the sparking end 32, 38 includes Cr, Pd, and a balance substantially of at least one of Mo and W. The Pd coating 48 is disposed over the bulk of the sparking end 32, 38 so that the sparking end 32, 38 comprises a gradient structure at all temperatures. As shown in FIG. 3*b*, the $Cr_2O_3$ layer 50 forms along the Pd coating 48 when the sparking end 32, 38 is heated to temperatures of at least 500° C., which is typically the operating temperature of an internal combustion engine.

The Pd coating 48 is applied to the sparking end 32, 38 of the electrode 22, 24 by a micro-coating process, such as electroplating. The Pd coating 48 may be disposed along the entire outer surface 34, 42 of the sparking end 32, 38, present only along the entire spark contact surface 36, 44, present only at portions of the outer surface 34, 42, or present only at portions of the spark contact surface 36, 44. The presence, amount, and thickness of the Pd coating 48 may be detected by heating the sparking end 32, 38 to a temperature of at least 500° C. and performing a chemical analysis on the sparking end 32, 38, or by generating and viewing an Energy Dispersive Spectra (E.D.S.) of the sparking end 32, 38 with an S.E.M. instrument.

The Pd coating 48 has a thickness substantially affecting the oxidation performance of the sparking end 32, 38. In one embodiment, Pd coating 48 has a thickness of 1.0 μm to 1000.0 μm or 1.0 millimeter (mm). In another embodiment, the Pd coating 48 has a thickness of 9.0 μm to 900.0 μm. In yet another embodiment, the Pd coating 48 has a thickness of 55.0 μm to 700.0 μm. In one embodiment, the thickness of the Pd coating 48 is consistent along the entire outer surface 34, 42 and spark contact surface 36, 44 of the sparking end 32, 38. In another embodiment, the thickness of the Pd coating 48 varies along the outer surface 34, 42 and spark contact surface 36, 44.

In one embodiment, the Pd coating 48 has a thickness of at least 2.0 μm. In another embodiment, the Pd coating 48 has a thickness of at least 64.0 μm. In another embodiment, the Pd coating 48 has a thickness of at least 390.0 μm.

In one embodiment, the Pd coating 48 has a thickness up to 1000.0 μm. In another embodiment, the Pd coating 48 has a thickness up to 534.0 μm. In another embodiment, the Pd coating 48 has a thickness up to 90.0 μm.

As stated above, one aspect of the invention provides a spark plug 20 for igniting a mixture of fuel and air in an internal combustion engine. The representative spark plug 20 of FIG. 1 includes a center electrode 22 and a ground electrode 24 and each including a sparking end 32, 38 formed of the high temperature performance alloy. However, in another embodiment, only the center electrode 22 includes the sparking end 32, 38 formed of the high temperature performance alloy and not the ground electrode 24. In yet another embodiment, only the ground electrode 24 includes the sparking end 32, 38 formed of the high temperature performance alloy and not the center electrode 22.

The sparking end 32, 38 of each electrode 22, 24 may be a tip, pad, disk, sphere, rivet, or other shaped portion. As alluded to above, at least one of the sparking ends 32, 38, but preferably both sparking ends 32, 38 of the spark plug 20 include the high temperature performance alloy. The high temperature performance alloy may be fabricated of powder metal materials. The powder metal material is formed into a sparking end (28, 32) of an electrode (22, 24) by press forming or other methods known in the art. Further, the powder metal material may be fabricated into the high temperature performance alloy by a variety of metallurgy processes, such as heating the powder metal material by sintering or arc melting.

The representative spark plug 20 of FIG. 1 also includes an insulator 26 of a ceramic material and a shell 28 of conductive metal material. The ceramic insulator 26 is generally annular and supportably placed inside the metal shell 28 so that the metal shell 28 surrounds a portion of the ceramic insulator 26.

The center electrode 22 of the representative spark plug 20 is placed within an axial bore of the ceramic insulator 26. The center electrode 22 includes a first base component 30 and a first sparking end 32. The first sparking end 32 presents a first outer surface 34 which includes a first spark contact surface 36, as shown in FIG. 1*b*. The first spark contact surface 36 extends beyond a front end of the ceramic insulator 26.

Figure 2:
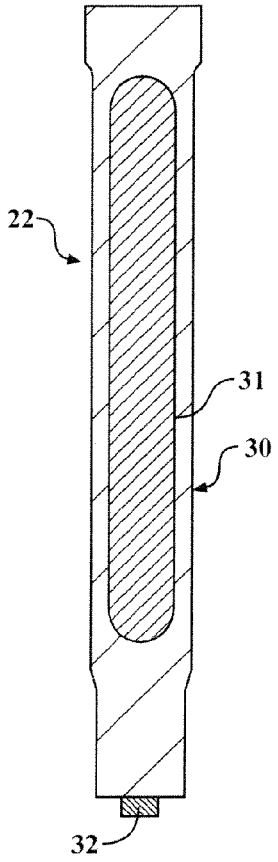
FIG. 2 is a longitudinal cross sectional view of a central electrode of a second embodiment before exposure to a temperature of at least 500° C.

In one embodiment, the first sparking end 32 formed of the high temperature performance alloy is independent of the first base component 30, as shown in FIGS. 1*a*, 1*b*, and 2. The first sparking end 32 is attached to the first base component 30. The first sparking end 32 may be fixedly welded, bonded, or otherwise attached to the first base component 40. In one embodiment the first base component 30 includes nickel or a nickel alloy. However, as stated above, the first sparking end 32 formed of the high temperature performance alloy does not include any intentionally added Ni and is substantially free of any Ni. In yet another embodiment, as shown in FIG. 2, the first base component 30 includes a first core 31 of a copper material, such as pure copper or a copper alloy.

In one embodiment, at least a portion of the first base component 30 of the center electrode 22 is also formed of the high temperature performance alloy. The first base component 30 and the first sparking end 32 are integral with one another, as shown in FIGS. 3*a* and 3*b*. The high thermal conductivity and relatively low cost of the high temperature performance alloy, compared to precious metal materials of the prior art, allow the center electrode 22 to be formed entirely of the high temperature performance alloy.

The ground electrode 24 of the representative spark plug 20 is fixedly welded or otherwise attached to a front end surface of the metal shell 28, as shown in FIG. 1. The ground electrode 24 includes a second base component 40 and a second sparking end 38. The second sparking end 38 presents a second outer surface 42 which includes a second spark contact surface 44, as shown in FIG. 1*b*. The second spark contact surface 44 is located proximate the first spark contact surface 36 of the center electrode 22. The spark contact surfaces 36, 44 define a spark gap 46 therebetween, as shown in FIGS. 1*a* and 1*b*.

Figure 4:
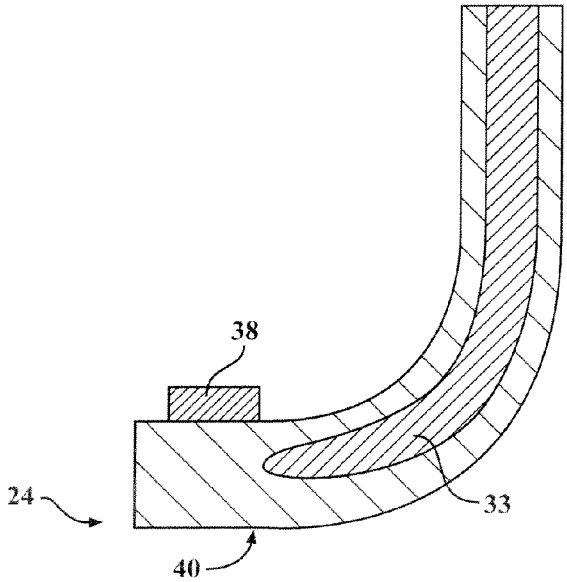
FIG. 4 is a longitudinal cross sectional view of a ground electrode of a forth embodiment before exposure to a temperature of at least 500° C.

In one embodiment, the second sparking end 38 formed of the high temperature performance alloy is independent of the second base component 40, as shown in FIGS. 1*a*, 1*b*, and 4. The ground electrode 24 is attached to the second base component 30. The second sparking end 38 may be fixedly welded, bonded, or otherwise attached to the second base component 40. In one embodiment, the second base component 30 includes Ni or a Ni alloy. However, as stated above, the second sparking end 38 formed of the high temperature performance alloy does not include any intentionally added Ni and is substantially free of any Ni. In yet another embodiment, the second base component 30 includes a second core 33 of copper material, such as pure copper or a copper alloy, as shown in FIG. 4.

In one embodiment, at least a portion of the second base component 40 of the ground electrode 24 is also formed of the high temperature performance alloy. The second base component 40 and the second sparking end 38 are integral with one another, as shown in FIGS. 5*a* and 5*b*. The high thermal conductivity and relatively low cost of the high temperature performance alloy, compared to precious metal sparking ends 32, 38 of the prior art, allow the entire ground electrode 24 to be formed of the high temperature performance alloy.

EXAMPLE 1

In one example embodiment, the sparking end 32, 38 formed of the high temperature performance alloy includes Cr in an amount of 49.0 weight percent, Pd in an amount of 2.0 weight percent, and tungsten in an amount of 49.0 weight percent. The high temperature performance alloy is fabricated of powder metal and sintered to a final disk shape having a diameter of 0.7 millimeters and a thickness of 1.0 millimeters.

EXAMPLE 2

In a second example embodiment, the sparking end 32, 38 formed of the high temperature performance alloy includes Cr in an amount of 39.0 weight percent, Pd in an amount of 2.0 weight percent, and tungsten in an amount of 59.0 weight percent. The high temperature performance alloy is fabricated of powder metal and sintered to the final shape.

Experiment 1—Hot Spark Erosion Rate

In a second experiment, the hot spark erosion rate of the sparking ends 32, 38 of Example 1 and Example 2, as well as eight additional example sparking ends 32, 38 formed of the high temperature performance alloy were compared to the hot spark erosion rate of comparative sparking ends formed of prior art precious metal alloys or prior art nickel alloys. The comparative sparking ends include the same dimensions as the example sparking ends 32, 38, having a diameter of 0.7 millimeters and a thickness of 1.0 millimeters. The compositions of the example sparking ends 32, 38 and prior art alloys of the comparative sparking ends are listed in Table 1.

Figure 6:
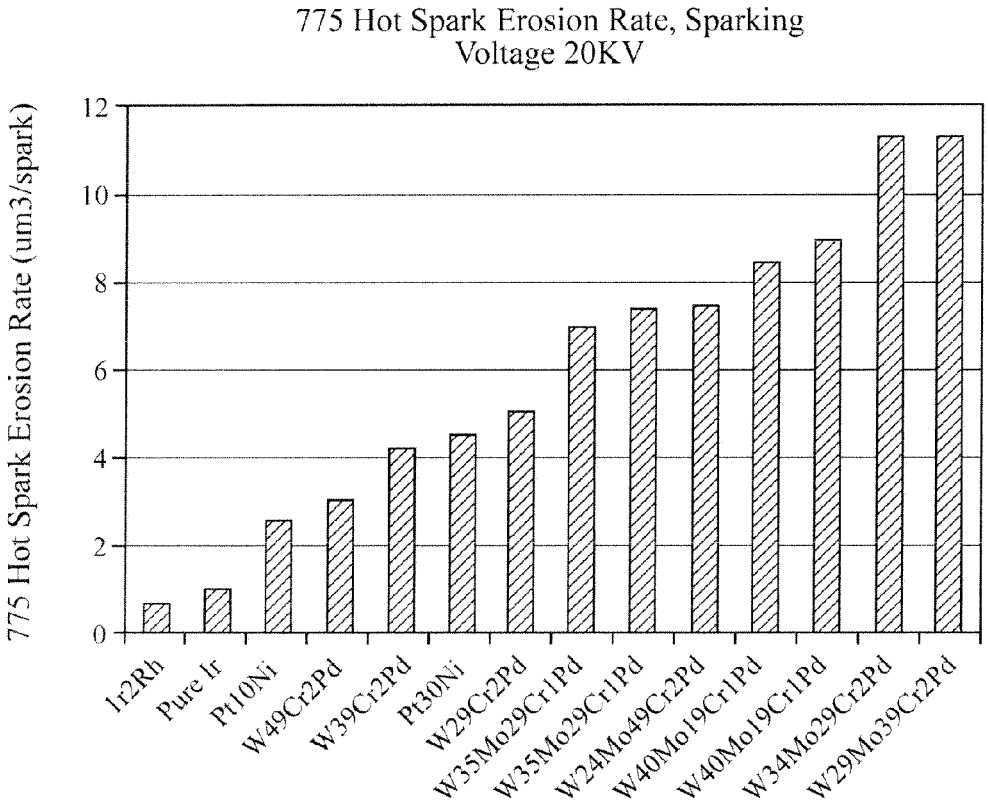
FIG. 6 is a graph illustrating spark erosion rate of inventive examples and comparative examples.

The example sparking ends 32, 38 and the comparative sparking ends were tested under conditions similar to those of an internal combustion engine. The hot spark erosion test simulates the environment, both the sparking conditions and temperature conditions. The samples were tested as a cathode for a 300 hours test. The samples were heated to and maintained at a temperature of 775° C., which is a typical operating temperature of an electrode 22, 24 of a spark plug 20, for the entire 300 hours. During the test, a sparking voltage of 20 KV was also maintained for the 300 hours. The sparking frequency was 158 Hz. The erosion rate is equal to the amount of material of the sample worn away per spark applied to the sample. The erosion rate provides an indication of the volume stability of the high temperature performance alloy. The erosion rate is measured in $\mu m_3$/spark. The erosion rate of the samples includes rate of erosion due to two erosion mechanisms, the high temperature oxidation erosion and spark erosion. The erosion rate of the samples of the hot spark erosion experiment is similar to the erosion rate of sparking ends used in an actual combustion engine. The erosion rates of the example sparking ends 32, 38 formed of the high temperature performance alloy and the erosion rates of the comparative sparking ends are also shown in Table 1. A graphical display of the spark erosion rate test results are shown in FIG. 6.

TABLE 1

| | Composition (weight percent, wt %) | Spark Erosion Rate ($\mu m^3$/spark) |
|---|---|---|
| Comparative Example 6 | 98 wt % Ir + 2 wt % Rh | 0.6 |
| Comparative Example 7 | 100 wt % Ir | 1.0 |
| Comparative Example 8 | 90 wt % Pt + 10 wt % Ni | 2.6 |
| Comparative Example 9 | 70 wt % Pt + 30 wt % Ni | 4.5 |
| Inventive Example 1 | 49 wt % Cr + 2 wt % Pd + 49 wt % W | 3.1 |
| Inventive Example 2 | 39 wt % Cr + 2 wt % Pd + 59 wt % W | 4.2 |
| Inventive Example 3 | 29 wt % Cr + 2 wt % Pd + 69 wt % W | 5.0 |
| Inventive Example 4 | 29 wt % Cr + 1 wt % Pd + 35 wt % Mo + 35 wt % W | 6.9 |
| Inventive Example 5 | 29 wt % Cr + 1 wt % Pd + 35 wt % Mo + 35 wt % W | 7.3 |
| Inventive Example 6 | 49 wt % Cr + 2 wt % Pd + 24 wt % Mo + 25 wt % W | 7.5 |
| Inventive Example 7 | 19 wt % Cr + 1 wt % Pd + 40 wt % Mo + 40 wt % W | 8.3 |
| Inventive Example 8 | 19 wt % Cr + 1 wt % Pd + 40 wt % Mo + 40 wt % W | 9.0 |
| Inventive Example 9 | 29 wt % Cr + 2 wt % Pd + 34 wt % Mo + 35 wt % W | 11.2 |
| Inventive Example 10 | 39 wt % Cr + 2 wt % Pd + 29 wt % Mo + 30 wt % W | 11.2 |

Conclusion of Experiments

The hot electrical spark erosion rate of the example sparking ends 32, 38 formed of high temperature performance alloy is about equal to the erosion rate of the Pt and Pt—Ni materials of the prior art. However, the high temperature performance alloy is better suited for spark plug electrodes 22, 24 because the example sparking ends 32, 38 formed of the high temperature performance alloy do not experience balling at temperatures greater than 500° C. Furthermore, the cost of the inventive alloys have significantly lower cost and are more readily available than precious metals, such as Pt and Pt—Ni alloys. Thus, the sparking ends 32, 38 formed of the high temperature performance alloy provides improved performance of the spark plug 20.

Obviously, many modifications and variations of the present invention are possible in light of the above teachings and may be practiced otherwise than as specifically described while within the scope of the appended claims. In addition, the reference numerals in the claims are merely for convenience and are not to be read in any way as limiting.

What is claimed is:

1. A spark plug comprising:

at least one electrode having a sparking end, said sparking end including a high temperature performance alloy, said high temperature performance alloy including, in weight percent of said high temperature performance alloy, chromium in an amount of 10.0 weight percent to 60.0 weight percent, palladium in an amount of 0.5 weight percent to 10.0 weight percent, and a balance substantially of at least one of molybdenum and tungsten.

2. The spark plug of claim 1 wherein said sparking end has a spark contact surface including a layer of chromium oxide ($Cr_2O_3$) at said spark contact surface at a temperature of at least about 500° C.

3. The spark plug of claim 2 wherein said sparking end has an outer surface including said spark contact surface and each of said surfaces includes said layer of chromium oxide ($Cr_2O_3$) at a temperature of at least about 500° C.

4. The spark plug of claim 1 wherein said high temperature performance alloy includes nickel in an amount less than 5.0 weight percent.

5. The spark plug of claim 1 wherein said high temperature performance alloy includes yttrium in an amount up to 0.2 weight percent.

6. The spark plug of claim 1 wherein said high temperature performance alloy includes at least one of silicon and manganese in an amount up to 2.0 weight percent.

7. The spark plug of claim 6 wherein said high temperature performance alloy includes silicon in an amount up to 0.5 weight percent.

8. The spark plug of claim 1 wherein said sparking end has an outer surface and includes a coating of palladium having a thickness of less than 1.0 millimeter at said outer surface.

9. The spark plug of claim 1 wherein said balance includes said at least one of molybdenum and tungsten in an amount of 10.5 weight percent to 90.0 weight percent.

10. The spark plug of claim 1 wherein said high temperature performance alloy includes chromium in an amount of 30.0 weight percent to 55.0 weight percent, palladium in an amount of 1.0 weight percent to 3.0 weight percent, and tungsten in an amount of 40.0 weight percent to 55.0 weight percent.

11. The spark plug of claim 1 wherein said electrode includes a base component and said base component and said sparking end are independent of one another and said sparking end is attached to said base component.

12. The spark plug of claim 1 wherein said electrode includes a base component formed at least in part of said high temperature performance alloy.

13. The spark plug of claim 12 wherein said base component and said sparking end are integral with one another.

14. The spark plug of claim 1 wherein said electrode includes a base component having a core of copper material.

15. The spark plug of claim 1 including a center electrode and a ground electrode.

16. The spark plug of claim 15 including an insulator of ceramic material having an axial bore, said center electrode being disposed in said axial bore of said insulator, a shell of conductive metal material surrounding said insulator, and said ground electrode being attached to said shell.

17. A spark plug comprising:

at least one electrode having a sparking end, said sparking end including a high temperature performance alloy, said high temperature performance alloy including, in weight percent of said high temperature performance alloy, chromium in an amount of 20.0 weight percent to 40.0 weight percent, palladium in an amount of 0.5 weight percent to 2.5 weight percent, tungsten in an amount of 25.0 weight percent to 45.0 weight percent, and molybdenum in an amount of 25.0 weight percent to 45.0 weight percent.

18. An electrode for use in a spark plug comprising:

a sparking end including a high temperature performance alloy, said high temperature performance alloy including, in weight percent of said high temperature performance alloy, chromium in an amount of 10.0 weight percent to 60.0 weight percent, palladium in an amount of 0.5 weight percent to 10.0 weight percent, and a balance substantially of at least one of molybdenum and tungsten.

19. A method of fabricating a spark plug (20) including an electrode (22, 24) having a sparking end (28, 32), comprising the steps of:

providing a power metal material including chromium, palladium, and at least one of molybdenum and tungsten, forming the powder metal material into a sparking end (28, 32) of an electrode (22, 24), and heating the powder metal material to provide a high temperature performance alloy, comprising, in weight percent of the high temperature performance alloy, chromium in an amount of 10.0 weight percent to 60.0 weight percent, palladium in an amount of 0.5 weight percent to 10.0 weight percent, and a balance substantially of at least one of molybdenum and tungsten.

20. The method of claim 19 including applying a coating 48 of palladium to the powder metal material before heating the powder metal material.

21. An electrode for use in a spark plug comprising:

a sparking end including a high temperature performance alloy, said high temperature performance alloy including chromium, palladium and at least one of tungsten or molybdenum, wherein the amount of the at least one of tungsten or molybdenum is greater than or equal to the amount of chromium, the amount of chromium is greater than or equal to the amount of palladium, and the amount of palladium is less than or equal to 3.0 weight percent.

* * * * *